US009521936B2

(12) United States Patent
Holz

(10) Patent No.: US 9,521,936 B2
(45) Date of Patent: Dec. 20, 2016

(54) VACUUM CLEANER

(71) Applicant: MIELE & CIE. KG, Guetersloh (DE)

(72) Inventor: Dominik Holz, Bielefeld (DE)

(73) Assignee: MIELE & CIE. KG, Guetersloh (DE)

( * ) Notice: Subject to any disclaimer, the term of this patent is extended or adjusted under 35 U.S.C. 154(b) by 335 days.

(21) Appl. No.: 14/187,451

(22) Filed: Feb. 24, 2014

(65) Prior Publication Data

US 2014/0237761 A1 Aug. 28, 2014

(30) Foreign Application Priority Data

Feb. 25, 2013 (DE) ..... 10 2013 101 809

(51) Int. Cl.
*A47L 9/16* (2006.01)
*A47L 9/10* (2006.01)
*A47L 9/20* (2006.01)

(52) U.S. Cl.
CPC ..... *A47L 9/16* (2013.01); *A47L 9/106* (2013.01); *A47L 9/1666* (2013.01); *A47L 9/1683* (2013.01); *A47L 9/20* (2013.01); *Y10T 29/49718* (2015.01)

(58) Field of Classification Search
CPC ..... A47L 9/106; A47L 9/16–9/1691; A47L 9/20
USPC ..... 15/347
See application file for complete search history.

(56) References Cited

U.S. PATENT DOCUMENTS 5,128,034 A * 7/1992 Kool ..... B01D 35/143 210/232
6,625,845 B2 * 9/2003 Matsumoto ..... A47L 9/108 15/352
9,279,555 B2 * 3/2016 Bassett ..... A47L 9/108
2004/0187253 A1 * 9/2004 Jin ..... A47L 9/20 15/352
2006/0137302 A1 * 6/2006 Min ..... A47L 9/1625 55/337
2006/0156508 A1 * 7/2006 Khalil ..... A47L 5/24 15/353
2010/0024367 A1 * 2/2010 Howes ..... A47L 9/1625 55/447
2013/0160233 A1 * 6/2013 Peace ..... A47L 9/1625 15/353

FOREIGN PATENT DOCUMENTS

DE 102009035619 A1 4/2011

* cited by examiner

*Primary Examiner* — Joseph J Hail
*Assistant Examiner* — Henry Kong
(74) *Attorney, Agent, or Firm* — Leydig, Voit & Mayer, Ltd.

(57) ABSTRACT

A bagless vacuum cleaner including a dust collection device. The dust collection device includes a dust collection container. The dust collection container includes a top cover disposed to close the dust collection container at a first end. A hinged bottom lid is disposed to close the dust collection container at a second end. The hinged bottom lid is adapted to be tilted to open the dust collection container. The dust collection device includes a coarse dirt separator disposed inside the dust collection container. The coarse dirt separator is movable vertically along a guide.

10 Claims, 9 Drawing Sheets

VACUUM CLEANER

CROSS-REFERENCE TO RELATED APPLICATIONS

Priority is claimed to German Patent Application No. DE 10 2013 101 809.2, filed on Feb. 25, 2013, the entire disclosure of which is hereby incorporated by reference herein.

FIELD

The present invention relates to a vacuum cleaner, in particular a bagless vacuum cleaner.

BACKGROUND

Bagless vacuum cleaners are per se known. German Patent Application DE102009035619A1 discloses a bagless vacuum cleaner having a removable dust collection device. For emptying purposes, the top cover can be removed from the removed dust collection device. In the case of this vacuum cleaner, emptying is accomplished by simply tipping the removed dust collection device over.

The present invention deals with the problem that there has not yet been provided an optimal method for emptying the dust collection device of such bagless vacuum cleaners having a central filter system. Until now, in order to empty the dust collection container of the dust collection device, it is usually required to remove a top cover from the dust collection container, and to then empty the dust collection container by turning it 180°. When emptying the dust collection container in this way, the dirt collected therein is sometimes heavily stirred up. This is unpleasant and also unhygienic for the user.

Furthermore, a circumferential horizontal coarse dirt separator collar is disposed in the dust collection container to separate coarse and fine dust. This coarse dirt separator collar is connected to the removable top cover. Typically, dirt particles are present on the coarse dirt separator collar and, therefore, these particles fall off in an uncontrolled manner when removing the top cover from the dust collection container. Even in the case of a bagless vacuum cleaner, where the bottom of the dust collection container can be opened to dispose of the fine dust collected there, any dirt that is separated by the circumferential coarse dirt separator collar remains above the collar. The circumferential coarse dirt separator collar would have to be removed separately by hand. In this case, too, dust can fall off the collar in an uncontrolled manner. This is unpleasant and unhygienic. In addition, the coarse dirt separator collar is relatively difficult to handle. Although the bagless vacuum cleaner must be cleaned at regular intervals to maintain its suction power, it is nevertheless likely that the user does not clean the dust collection device as often as would be required. This not only results in a decrease in the suction power of the bagless vacuum cleaner, but may also lead to unhygienic conditions due to the dirt which then remains in the dust collection container for a longer period of time.

SUMMARY

In an embodiment, the present invention provides a bagless vacuum cleaner including a dust collection device. The dust collection device includes a dust collection container. The dust collection container includes a top cover disposed to close the dust collection container at a first end thereof. A hinged bottom lid is disposed to close the dust collection container at a second end thereof. The hinged bottom lid is adapted to be tilted to open the dust collection container. The dust collection device includes a coarse dirt separator disposed inside the dust collection container. The coarse dirt separator is movable vertically along a guide.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
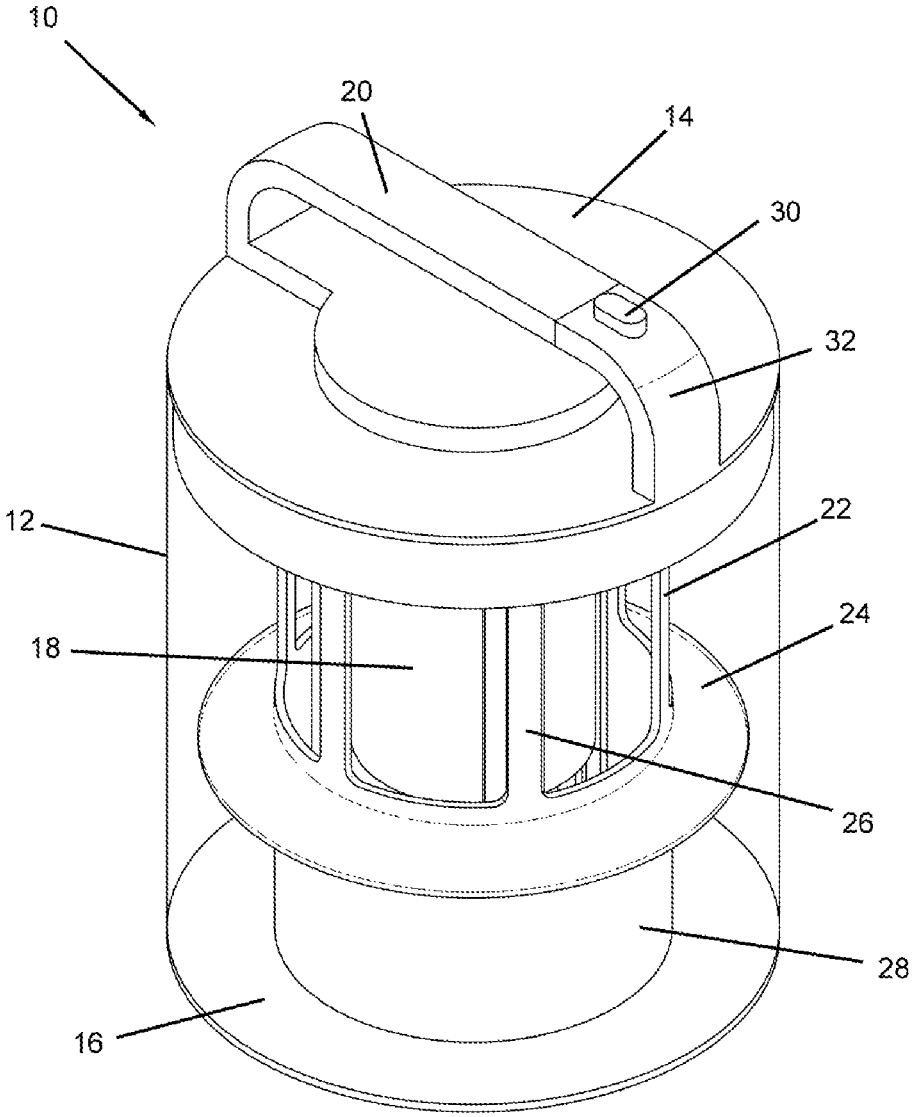
FIG. 1 is an isometric view of a dust collection device.

In an embodiment, the present invention provides a vacuum cleaner, in particular a bagless vacuum cleaner, having a dust collection device including a dust collection container with a top cover closing the dust collection container at a first end and a hinged bottom lid which closes the dust collection container at a second end and can be tilted to open the dust collection container, a coarse dirt separator which is movable vertically along a guide is provided inside the dust collection container.

The vertical movability of the coarse dirt separator along a guide provided for this purpose allows the coarse dirt separator to move out from the interior of the dust collection container in a controlled manner, so that it is then accessible for cleaning, and dirt deposited on the coarse dirt separator collar can fall off in a controlled manner.

In an embodiment, the present invention also provides a method for using such a vacuum cleaner or bagless vacuum cleaner, as will be described hereinbelow, in which in order to clean the dust collection container of the dust collection device, an opening button externally accessible on the dust collection device is pressed, thereby opening the bottom lid, whereupon the coarse dirt separator, which is vertically movable along its guide, moves down and slides out from the interior of the dust collection container.

An embodiment of the vacuum cleaner, in particular of the bagless vacuum cleaner, which allows this method to be implemented in a particularly simple way has the feature that the vertical movement of the coarse dirt separator can be caused by the user opening the bottom lid, and that the opening of the bottom lid can be caused by pressing an opening button provided on the outside of the top cover.

An advantage of this method results in particular from the fact that the user can cause the emptying of the dust collection container in a particularly easy and simple manner, just by pressing the opening button. Pressing the opening button causes the bottom lid to open, and opening of the bottom lid in turn causes the coarse dirt separator to move out from the interior of the dust collection container in a controlled manner along its guide. Thus, the user can cause the dust collection container to be emptied at the press of a button. The user does not need to perform any further operations, such as, in particular, operations which were heretofore necessary and would bring the user into contact with the collected dirt.

If, when the bottom lid is in the closed position, the coarse dirt separator rests on the surface of the bottom lid that faces the interior of the dust collection container, then a particularly simple operative relationship is provided between the hinged bottom lid and the position of the coarse dirt separator in the dust collection container. This is because when the coarse dirt separator rests on the surface of the bottom lid, this supporting function ceases to exist as soon as the bottom lid is opened. Thus, the coarse dirt separator can move out of the dust collection container along its guide immediately after the bottom lid is opened.

In an embodiment of such a vacuum cleaner, the vertically movability of the coarse dirt separator causes the coarse dirt separator to slide out from the interior of the dust collection container under the action of gravity alone when the bottom lid is open. Thus, the coarse separator begins to slide out from the interior of the dust collection container immediately as the bottom lid is opened and only under the action of gravity, which eliminates the need for the user to separately trigger the sliding-out of the coarse dirt separator and also eliminates the need for complex kinematics to accomplish such sliding-out.

When the vertical movement of the coarse dirt separator can be caused by the user opening the bottom lid, and the opening of the bottom lid can, in turn, be caused by pressing an opening button provided on the outside of the top cover, then the emptying of the dust collection container can be initiated simply by pressing the opening button; i.e., with a single press of a button by the user.

In an embodiment of the vacuum cleaner, the guide enabling the vertical movement of the coarse dirt separator is formed by a plurality of vertically oriented and longitudinally slotted holders, the slots of which are each engaged by a nose formed or molded on the coarse dirt separator. The orientation of the holders; i.e., their vertical orientation parallel to the longitudinal axis of the cylindrical dust collection container determines the direction in which the coarse dirt separator is movable along the guide. In accordance with this orientation, the coarse dirt separator is therefore movable along the longitudinal axis of the cylindrical dust collection container itself. Since the holders, or at least individual holders, are slotted in the longitudinal direction and these slots are each by a nose that is formed or molded on the coarse dirt separator or attached thereto in any other suitable way, the coarse dirt separator is capable of moving vertically in a defined manner due to the movement of the noses within the respective slots. As a result of the friction occurring between the noses and the respective adjacent surface portions of the longitudinal slots during sliding-out of the coarse dirt separator from the dust collection container, the coarse dirt separator slides out from the dust collection container relatively slowly. The dimensions of the noses and the width of the longitudinal slots in the holders of the guide are suitably matched for this purpose. As an alternative to noses guided in such slots, in another possible variant, a non-slotted holder may be partially laterally embraced by U-shaped projections or the like.

In an embodiment of the vacuum cleaner, in which the guide terminates in a circumferential ring that limits the slots in the holders, the coarse dirt separator can slide out from the dust collection container only until the noses strike the ring, which acts as a stop for the vertical movement of the coarse dirt separator. Thus, the coarse dirt separator cannot completely detach from the dust collection container, so that the coarse dirt separator can be easily moved back into the dust collection container, for example, by simply turning the dust collection container over, so that the coarse dirt separator begins to move again under the action of gravity alone, this time sliding back into the interior of the dust collection chamber.

In another embodiment of the vacuum cleaner, the coarse dirt separator has a collar which slopes toward the outer edge and which may also be referred to as coarse dirt separator collar. The advantage of this embodiment is that as the coarse dirt separator slides out from the dust collection container, any dirt lying on the coarse dirt separator collar can immediately fall off as soon the coarse dirt separator collar is outside of the dust collection container. Thus, it is generally not necessary to shake the dust collection container, which may otherwise be required.

In an embodiment of the vacuum cleaner of the type discussed herein and described below, a central filter is positioned centrally within the dust collection container and is detachable from the vacuum cleaner by means of a central filter handle accessible on the outside of the vacuum cleaner. Since the central filter can be detached from the vacuum cleaner by an externally accessible handle, the user does not need to reach into the dust collection container to detach the central filter for cleaning, as is often required in the prior art. The ability to detach the central filter by performing a manipulation on the outside of the dust collection device, here by operating the central filter handle, greatly increases the ease of use for the user and also eliminates the need to touch dirt-laden, or potentially dirt-laden, parts inside the dust collection device, so that the cleaning of the central filter can be carried out by the user in a simple and hygienic manner.

In an embodiment of the vacuum cleaner, in which the central filter can be removed in the manner described by means of an externally accessible handle thereof, the central filter handle is in alignment with a fixed handle portion carrying the opening button when the central filter is fitted in the dust collection device. Thus, the central filter handle and the fixed handle portion together form a handle for manipulating the dust collection device. Accordingly, only those elements which are absolutely necessary are disposed on the outer surface of the vacuum cleaner. Moreover, the handle of the central filter and the fixed handle portion both have a double function in that the central filter handle can be used to remove the central filter and to manipulate the dust collection device when the central filter is in the inserted position, and in that the rigid handle portion functions as a mounting location for the opening button and also as a vacuum cleaner handle, or at least as a portion thereof, when the vacuum cleaner is being manipulated during vacuuming.

An exemplary embodiment of the present invention is shown in the drawings in a purely schematic way and will be described in more detail below. Corresponding objects or elements are identified by the same reference numerals in all figures. The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps.

Figure 9:
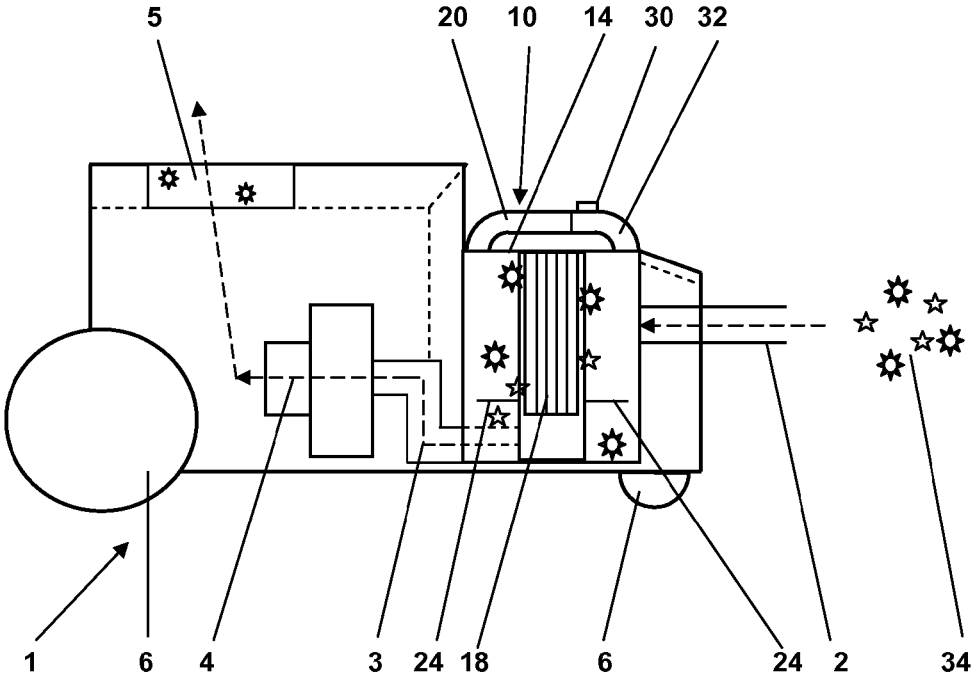
FIG. 9 is a schematic view showing a vacuum cleaner with the dust collection device.

FIG. 1 shows an embodiment of the dust collection device 10 according to the present invention, which is disposed in vacuum cleaner 1 (FIG. 9). Dust collection device 10 includes a cylindrical dust collection container 12, a top cover 14, and a bottom lid 16. The wall of dust collection container 12 is typically transparent, partially transparent, or semi-transparent, and made of materials suitable for this purpose. Top cover 14 is shown fitted on dust collection container 12 and is attached thereto, for example, by a bayonet coupling or the like. Bottom lid 16 is shown in a closed configuration.

A cylindrical central filter 18 is positioned centrally within dust collection container 12. Central filter 18 includes a handle 20, which is accessible above top cover 14. In the interior of dust collection container 12, a coarse dirt separator 22 surrounds central filter 18. At its lower end, most remote from top cover 14, coarse dirt separator 22 has a coarse dirt separator collar, hereinafter often also referred to in short as collar 24. As can be seen, coarse dirt separator 22 includes a plurality of equidistantly spaced bars 26, which carry at their lower end a collar 24 extending beyond a circumferential line defined by the positions of bars 26. A filter mesh of coarse dirt separator 22 is disposed between bars 26 or behind bars 26. A gap remains between the outer edge of collar 24 and the inner surface of dust collection container 12, allowing dust and coarse dirt to fall therethrough to the bottom of dust collection container 12. A hollow cylindrical portion 28 extends from below collar 24 to bottom lid 16.

An opening button 30 for opening bottom lid 16 is provided on the outside of top cover 14 on a separate handle portion 32, which is independent from central filter handle 20. Central filter handle 20 and the handle portion 32 with opening button 30 are shaped such that when central filter 18 is inserted in dust collection device 10, both handle portions 20, 32 merge into one another in an edgeless manner and together form a handle for manipulating vacuum cleaner 1 and dust collection device 10. For this purpose, the handle portion 32 with opening button 30 is an integral part of top cover 14. Central filter handle 20 is an integral part of a carrier structure of central filter 18 receiving a filter medium. Central filter 18 is lockably attachable to top cover 14. In the locked position, central filter handle 20 is in alignment with the fixedly oriented handle portion 32, resulting in the described edgeless transition.

Figure 2:
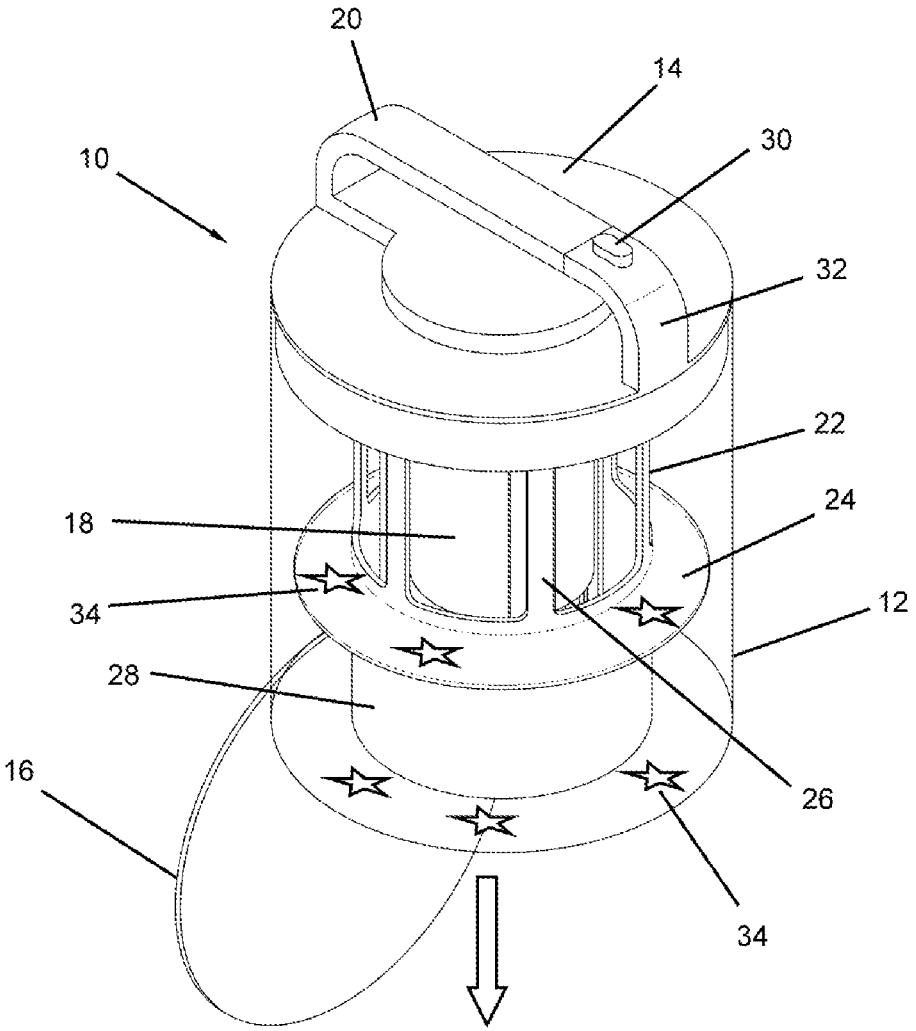
FIG. 2 is a view showing the dust collection device of FIG. 1 with the bottom lid open as a first snapshot during the emptying of a dust collection container forming part of the dust collection device.

By pressing opening button 30, the bottom of dust collection container 12 can be opened by opening bottom lid 16, as is shown in the view of FIG. 2. Opening of bottom lid 16 by opening button 30 can be accomplished by a simple mechanism, such as a lever mechanism, which may, for example, release from locking engagement a latching hook which is provided on bottom lid 16 and engages behind a latching nose formed on the inner surface of dust collection container 12. To enable pivoting movements of bottom lid 16 on dust collection container 12, bottom lid 16 is suitably hinged to dust collection container 12.

Opening of dust collection container 12 serves for discharging dust and other dirt particles collected in dust collection container 12. The dust and dirt particles are shown in simplified schematic form as stars in FIG. 2 and also in other figures, where relevant. The dust and dirt particles are hereinafter collectively referred to as dirt 34. During operation of vacuum cleaner 1, such dirt 34 accumulates on collar 24 as well as on the bottom of dust collection container 12; i.e., on the surface of bottom lid 16. When opening bottom lid 16, dirt 34 located on the bottom of dust collection container 12 can be disposed of from dust collection container 12. This means that the dirt 34 shown in FIG. 2 in the plane defined by the closed bottom lid 16 falls out of dust collection container 12 upon opening of bottom lid 16, as is indicated by the downward pointing block arrow. Thus, the user who, in order to empty dust collection container 12, holds dust collection device 10 over a suitable container for receiving the dirt 34 to be disposed of does not come into contact therewith during the opening of dust collection container 12. In addition, any dirt 34 located on collar 24 of coarse dirt separator 22 initially remains inside dust collection container 12.

Figure 3:
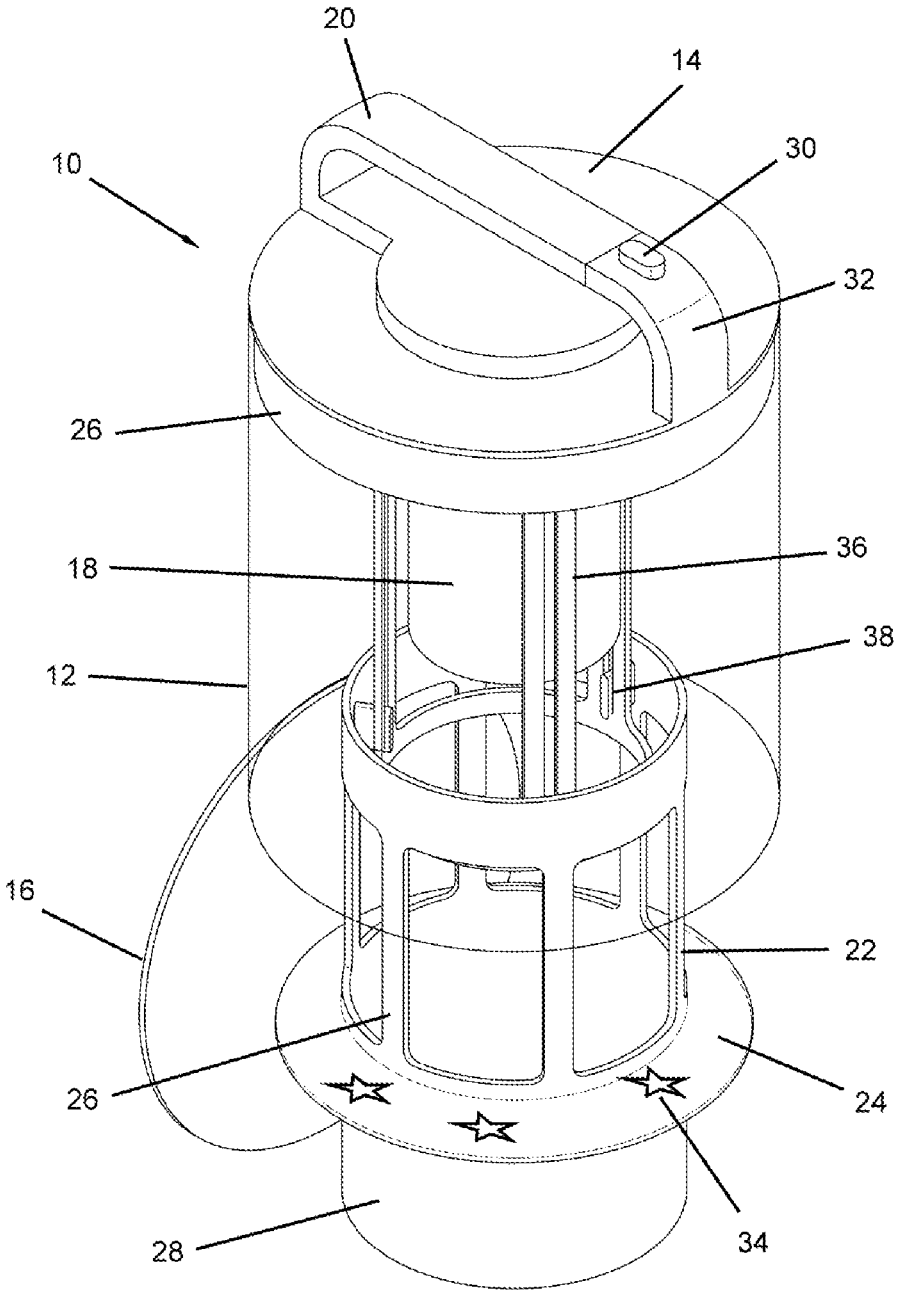
FIG. 3 is a view of the dust collection device of FIG. 1 showing the bottom lid open and a coarse dirt separator moved out from the interior of the dust collection container as another snapshot during the emptying of the dust collection container.

The view of FIG. 3 illustrates the disposal of dirt 34 located on collar 24 of coarse dirt separator 22. As shown, coarse dirt separator 22 is mounted on a guide 36 within dust collection container 12. In the exemplary embodiment shown, guide 36 is formed by three longitudinally slotted holders, the slots of which are each engaged by a nose 38 formed on the inner surface of coarse dirt separator 22. Noses 38 are located on a ring which is formed at an upper end of coarse dirt separator 22 and from which extend the bars 26. Noses 38 are interlockingly disposed in the slots of guide 36 in frictional engagement therewith. Thus, coarse dirt separator 22 is vertically guided in guide 36 at several (here three) points.

When opening bottom lid 16, coarse dirt separator 22, which previously rested with its lower hollow cylindrical portion 28 on the inner surface of bottom lid 16, hangs freely in guide 36. Then, coarse dirt separator 22 moves downwardly in guide 36 under the action of gravity until a configuration such as shown in FIG. 3 is reached. Guide 36 terminates in a ring uniting the longitudinally slotted holders, so that this ring also functions as a limit stop for the vertical movement of coarse dirt separator 22, thereby defining a lowermost position of coarse dirt separator 22.

When opening bottom lid 16, it is immediately pivoted, either under the action of gravity alone or, for example, with the assistance of a spring. In contrast, due to the frictional engagement of noses 38 within guide 36, the downward movement of coarse dirt separator 22 along guide 36 takes place gradually and is thus delayed with respect to the opening of bottom lid 16. In any case, the lowermost position of coarse dirt separator 22 shown in FIG. 3 is not reached until the dirt 34 previously located on the bottom of dust collection container 12 (see FIG. 2 and associated description) has fallen out of dust collection container 12. Accordingly, the different dirt constituents; i.e., fine dust and coarse dust, can be disposed of successively. By changing the position of the opened dust collection device 10 above the container intended for the disposal of the picked up dirt 34, the user can, for example, prevent coarser dirt components retained on collar 24 from falling into the fine dust previously disposed of, which would undesirably stir up the fine dust.

Further, the falling off of dirt 34 from collar 23 is assisted by the nature of the movement of coarse dirt separator 22 in guide 36. Since the vertical downward movement of coarse dirt separator 22 abruptly stops upon reaching the end of guide 36, the inertia of the mass that has previously been moved during the downward sliding of coarse dirt separator 22 causes a jerky movement of the vacuum cleaner 10 held by the user, thereby causing dirt 34 to be thrown off of collar 24. In a specific embodiment, the falling off of the dirt from collar 24 is additionally assisted by a slight slope of collar 24 toward the outer edge; i.e., in that collar 24 has an overall slightly conical configuration. Dirt 34 can then easily fall off of collar 24 already during the downward sliding of coarse dirt separator 22 in guide 36; i.e., at least once collar 24 moves out from the interior of dust collection container 12. Moreover, in the case of a downwardly sloping collar 24, the above-described jerk at the end of the downward movement of coarse dirt separator 22 can particularly facilitate the falling off of dirt 34 from collar 24.

In the configuration shown in FIG. 3, in which coarse dirt separator 22 hangs in guide 36 under dust collection container 12, any dirt that may remain on the filter mesh of coarse dirt separator 22 can be easily removed, for example, by knocking it off, or the like. Upon completion of these simple steps, which may be performed by the user with one hand (the user holds dust collection device 10 by handle 20, 32 and presses opening button 30 with the same hand, thereby triggering the above-described processes; i.e., the opening of bottom lid 16 and the downward sliding of coarse dirt separator 22), the interior of dust collection container 12 is free, or at least substantially free, of the dirt 34 previously collected therein.

Figure 4:
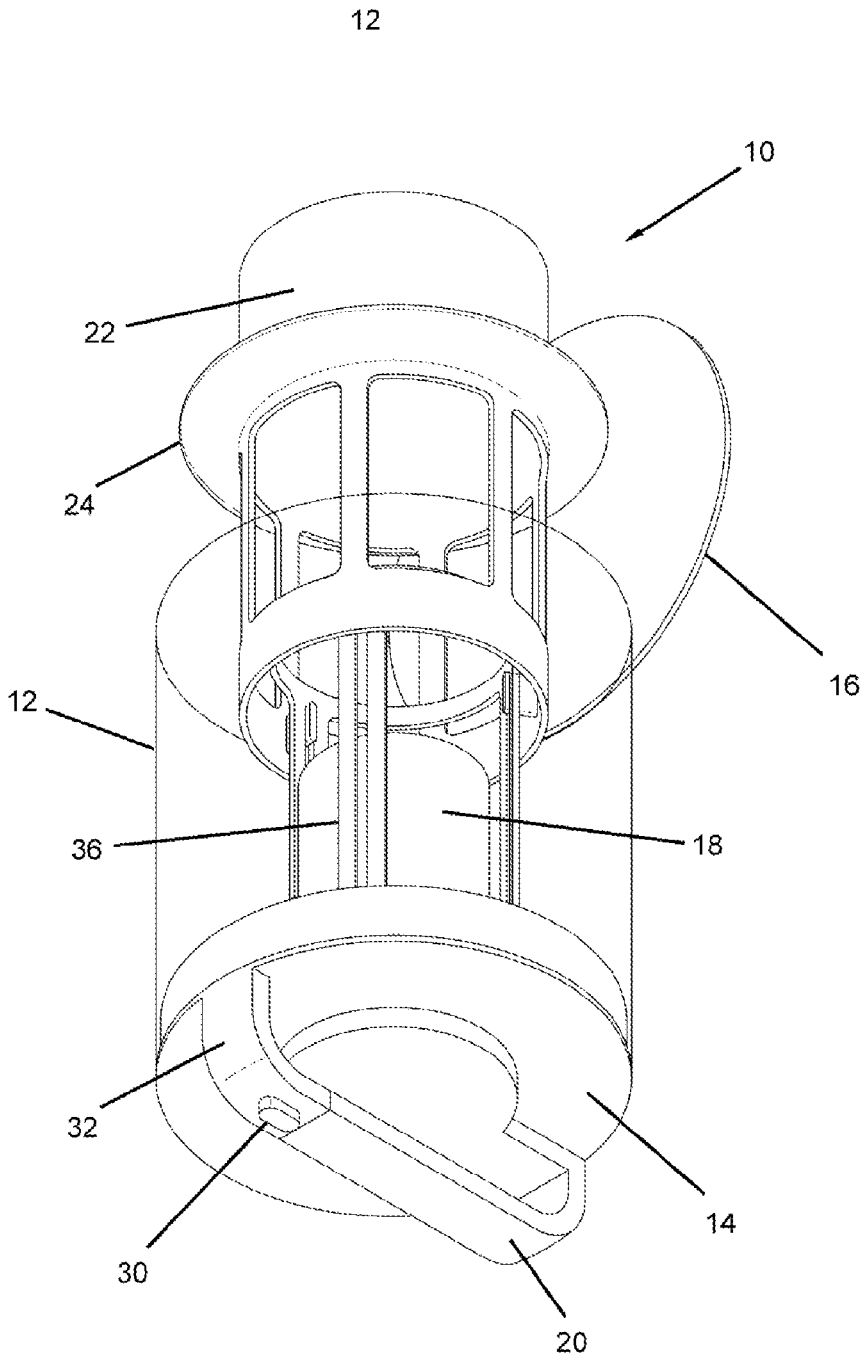
FIGS. 4 and 5 are snapshots of moments during the closing of the dust collection container after the emptying thereof.
Figure 5:
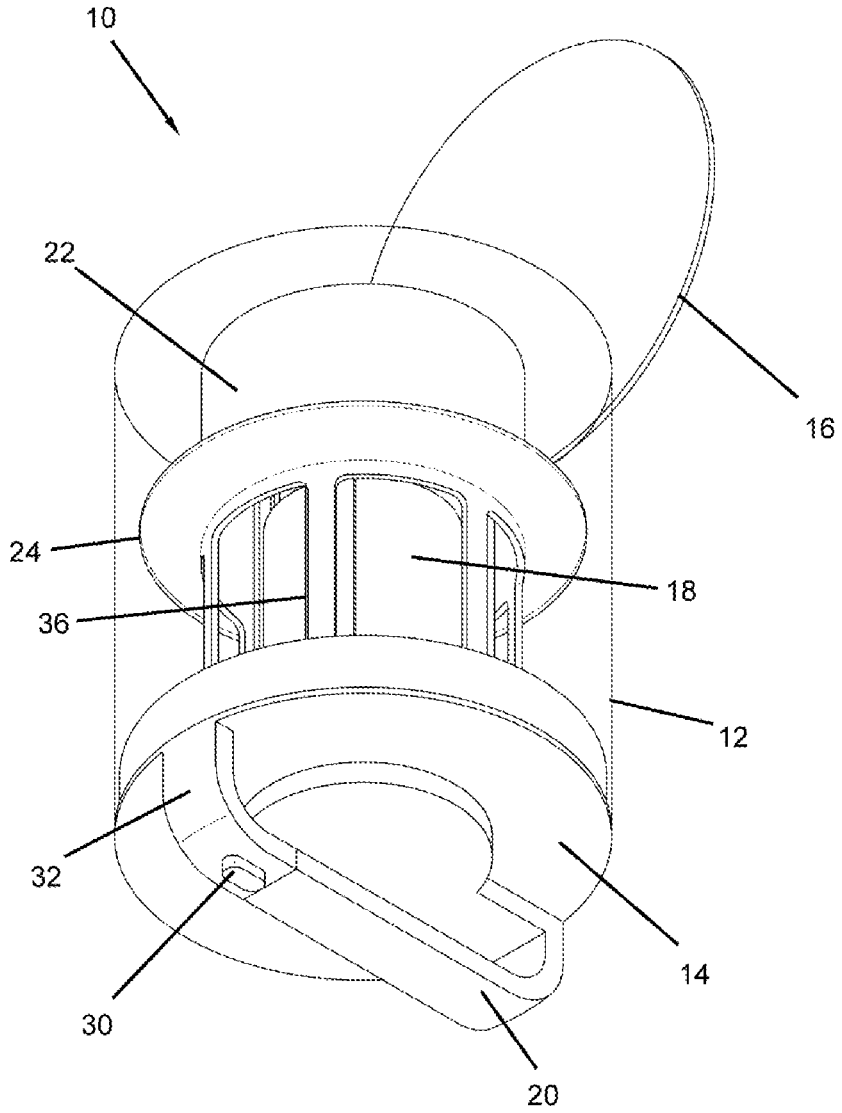

In order to close dust collection container 12, the user turns dust collection device 10 over, so that the lower edge of dust collection container 12, which has bottom lid 6 attached thereto and which previously faced downwardly during emptying, now faces upwardly, as is shown in FIG. 4. After such a 180° turn of dust collection device 10, coarse dirt separator 22 slides downwardly in guide 36, and thus back into the interior of dust collection container 12. This is illustrated in the view of FIG. 5. After that, bottom lid 16 may be closed.

The further description given with reference to the following figures relates to a thorough cleaning of dust collection device 10. Such thorough cleaning is useful to keep the suction power of vacuum cleaner 1 (FIG. 9) at a high level over a long period of time. To this end, central filter 18 is washed out at regular intervals. Furthermore, such a thorough cleaning usually also includes rinsing out of dust collection container 12 and/or rinsing of coarse dirt separator 22.

Figure 6:
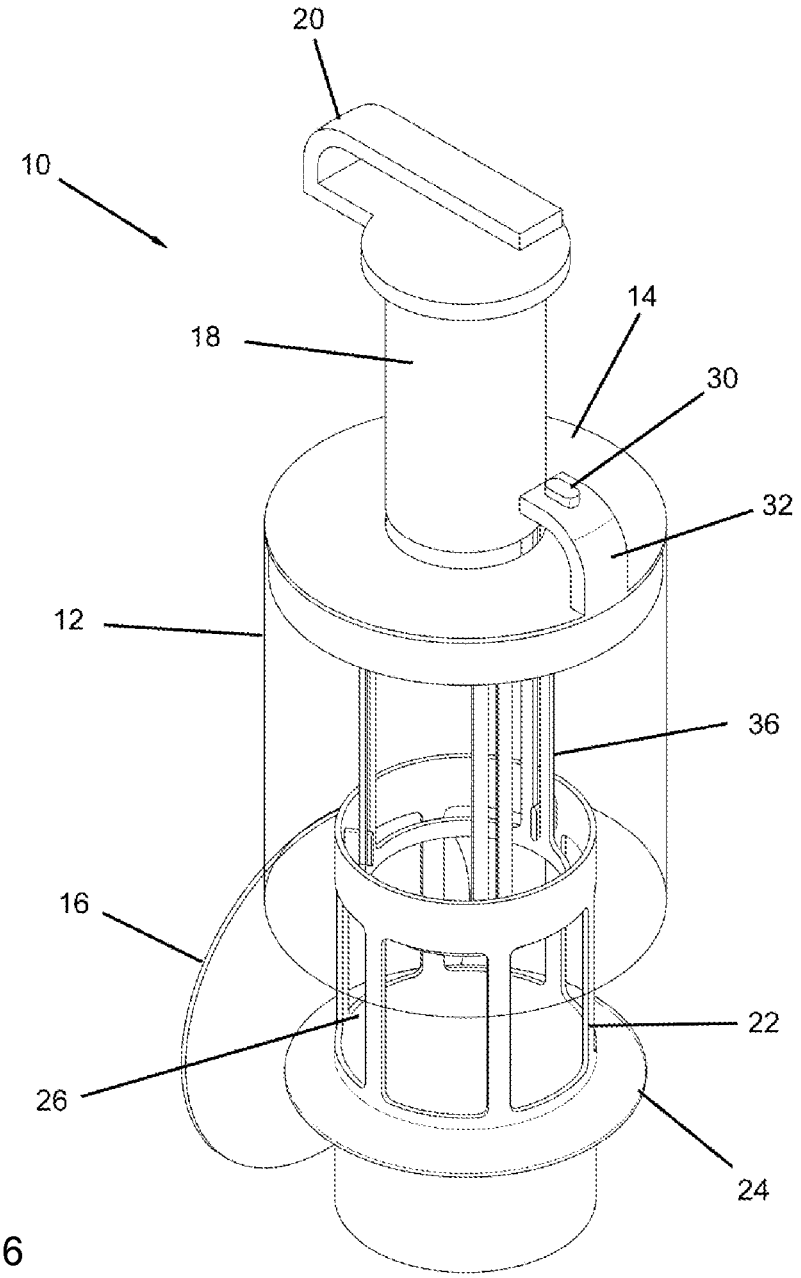
FIG. 6 is a snapshot of a moment during the removal of the central filter from the dust collection device.

In this regard, FIG. 6 shows a first snapshot representing a moment during the removal of central filter 18 from dust collection device 10. To remove central filter 18, it is withdrawn vertically upwardly from dust collection container 12, as shown. To this end, for example, a locking engagement holding central filter 18 in dust collection container 12 is released, or a frictional engagement is released, which frictional engagement is provided, for example, in that central filter 18 has a section of enlarged radius at the upper end of the cylindrical portion, and in that a seal carried, for example, by a circumferential collar on the underside of top cover 14 engages this section of enlarged radius in the interior of dust collection container 12.

As shown in FIG. 6, central filter 18 can be removed when bottom lid 16 is open and coarse dirt separator 22 is in the lowered position. However, it can also be removed when bottom lid 16 is closed and coarse dirt separator 22 is accordingly located in dust collection container 12.

Figure 7:
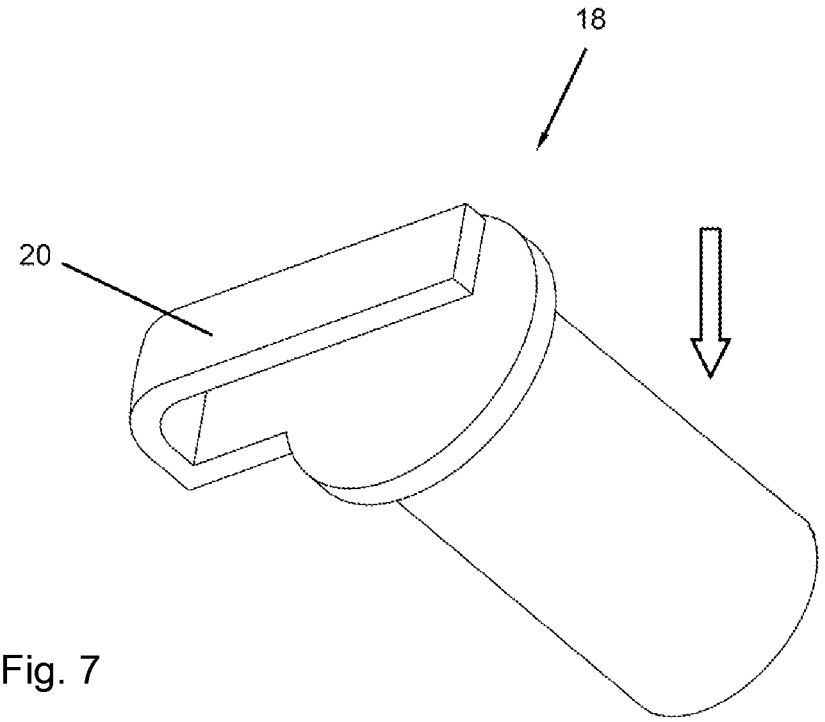
FIG. 7 is a view showing the central filter in a position removed from the dust collection device, where it can, for example, be rinsed under water for thorough cleaning.

Referring now to FIG. 7, central filter 18 is shown after removal from dust collection device 10. The user can manipulate the central filter by its handle 20 in a simple and hygienic manner and can both beat it clean and hold it under a jet of water in this way. In particular, cleaning under running water (indicated in FIG. 7 by the downward pointing block arrow) ensures that central filter 18 is cleaned to a sufficient degree, thereby keeping up the suction power of vacuum cleaner 1.

Figure 8:
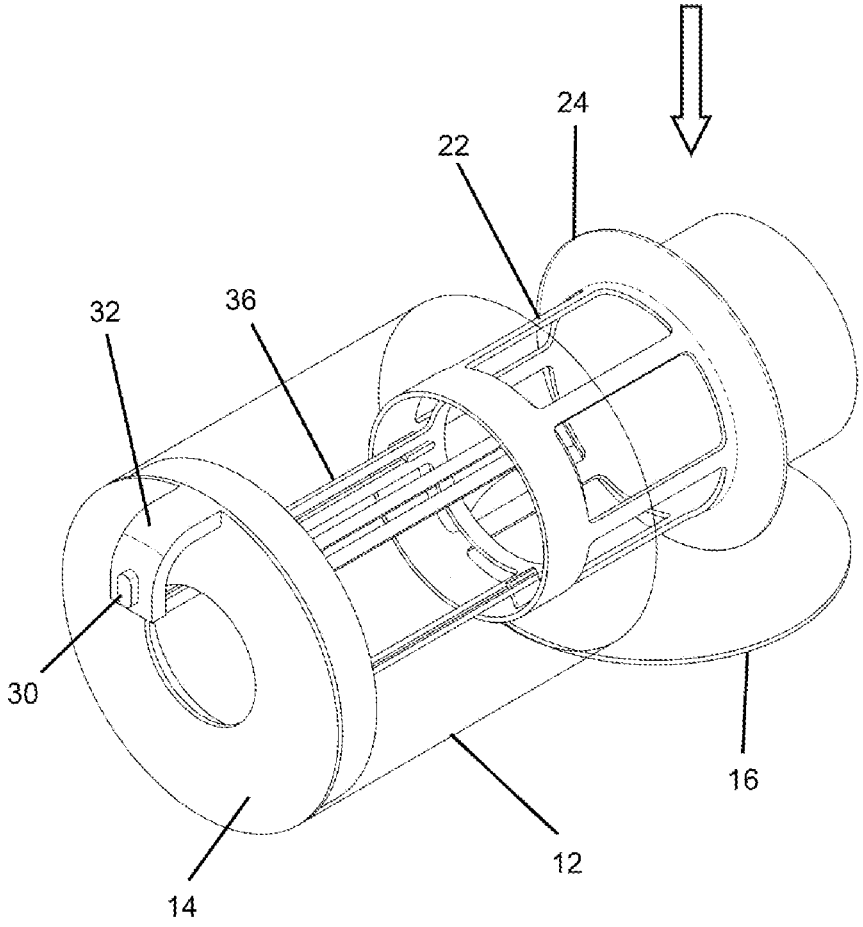
FIG. 8 is a view showing the body of the dust collection device without central filter, with the bottom lid open, and with the coarse dirt separator slid out from the interior of the dust collection container; i.e., a configuration which allows the dust collection container and the coarse dirt separator to be thoroughly cleaned as well, for example, under running water.

Finally, FIG. 8 shows dust collection container 12 with central filter 18 removed and bottom lid 16 open. Coarse dirt separator 22 and the inner surface of dust collection container 12 can also be cleaned under running water, which is here also indicated by the downward pointing block arrow. In such a cleaning operation, too, the user can hold dust collection container 12 and coarse dirt separator 22 simultaneously by fixed handle portion 32 and/or by the outer surface of dust collection container 12 in a simple and hygienic manner without coming into contact with dirt-laden or previously dirt-laden parts. Thus, the entire process of thorough cleaning of vacuum cleaner 1; i.e., of dust collection device 10, including cleaning of central filter 18 as well as cleaning of dust collection container 12 and coarse dirt separator 22 can be quickly and easily carried out in a manner that is particularly hygienic for the user.

FIG. 9 is a schematic view showing a vacuum cleaner 1 having a removable dust collection device 10. Dust collection device 10 is disposed in the flow path between suction port 2 and fan 4. During operation of vacuum cleaner 1, air laden with dirt 34 is conveyed through suction port 2 into dust collection device 10 as a result of the vacuum created by fan 4. The flow toward dust collection device 10 is advantageously from the side. The air circulates around the central filter 18 disposed centrally within dust collection container 12. In the process, coarse dirt is separated by the coarse dirt separator and collects under the sloping collar 24; i.e., in the region between collar 24 and lid 16. Then, the air is cleaned of fine dust particles by central filter 18 and discharged from dust collection device 10, preferably laterally or downwardly. The air cleaned by the dust collection device is passed through air ducts 3 and fan 4 to exhaust port 5, where an additional filter known as "hygiene filter" is located. This hygiene filter removes from the air any remaining allergenic substances that could not yet be separated by dust collection device 10. It is also illustrated that separator device 10 can be removed from vacuum cleaner 1 by handle 20, 32. Also shown is the already described opening button 30 on handle portion 32. Furthermore, it is illustrated that vacuum cleaner 1 has wheels 6 allowing the user to easily maneuver the vacuum cleaner during use.

Thus, various salient aspects of the description given herein can be summarized as follows: There is provided a vacuum cleaner 1, in particular a bagless vacuum cleaner, whose dust collection device 10 can be cleaned by the user in a particularly simple and easy way, and whose dust collection container 12 can be emptied particularly easily in a manner that is both simple and hygienic for the user. For this purpose, dust collection device 10 has a hinged bottom lid 16 at a lower end of the dust collection container, as well as a coarse dirt separator 22 which is vertically movable along a guide 36 provided in the interior of dust collection container 12. Hinged bottom lid 16 facilitates disposal of dirt 34 that has deposited in the bottom region of dust collection container 12. The vertical movability of coarse dirt separator 22 facilitates disposal of dirt 34 that has been retained by coarse dirt separator 22 and therefore has not reached the bottom of dust collection container 12.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 vacuum cleaner
2 suction port (suction hose)
3 air duct
4 fan
5 exhaust port (hygiene filter)
6 wheel
10 dust collection device
12 dust collection container
14 top cover
16 lid
18 central filter
20 central filter handle
22 coarse dirt separator
24 collar (coarse dirt separator collar)
26 bar (of the coarse dirt separator)
28 hollow cylindrical portion
30 opening button
32 handle portion
34 dirt
36 guide
38 nose

What is claimed is:

1. A vacuum cleaner comprising:
a dust collection device including:
a dust collection container including:
a top cover configured to close the dust collection container at a first end thereof; and
a hinged bottom lid configured to close the dust collection container at a second end thereof, the hinged bottom lid tiltable so as to open the dust collection container; and
a coarse dirt separator disposed inside the dust collection container, the coarse dirt separator being movable vertically along a guide,
wherein the guide includes a plurality of vertically oriented and longitudinally slotted holders, each holder being engaged by a nose included on the coarse dirt separator.

2. The vacuum cleaner recited in claim 1, wherein the vacuum cleaner is a bagless vacuum cleaner.

3. The vacuum cleaner recited in claim 1, wherein the coarse dirt separator rests on a surface of the hinged bottom lid that faces the interior of the dust collection container when the hinged bottom lid is in a closed position.

4. The vacuum cleaner recited in claim 3, wherein the vertical movability of the coarse dirt separator causes the coarse dirt separator to slide out from the interior of the dust collection container under the action of gravity when the hinged bottom lid is open.

5. The vacuum cleaner recited in claim 1 further comprising an opening button disposed on an outside of the top cover, wherein pressing the opening button causes the hinged bottom lid to open, and wherein opening the hinged bottom lid causes vertical movement of the coarse dirt separator.

6. The vacuum cleaner recited in claim 1, wherein the guide terminates in a circumferential ring that limits the slots in the holders.

7. The vacuum cleaner recited in claim 1, wherein the coarse dirt separator includes a collar that slopes toward an outer edge thereof.

8. The vacuum cleaner recited in claim 1, further comprising a central filter disposed centrally within the dust collection container, the central filter being detachable from the bagless vacuum cleaner using a central filter handle disposed on the outside of the dust collection container.

9. The vacuum cleaner recited in claim 8 further comprising an opening button disposed on a fixed handle portion of an outside of the top cover, wherein the central filter handle is in alignment with the fixed handle portion when the central filter is disposed in the dust collection device.

10. A method of emptying a dust collector of vacuum cleaner, the method comprising:
providing a dust collection device comprising:
a dust collection container including:
a top cover disposed to close the dust collection container at a first end thereof; and
a hinged bottom lid disposed to close the dust collection container at a second end thereof, the hinged bottom lid adapted to be tilted to open the dust collection container;
a coarse dirt separator inside the dust collection container, the coarse dirt separator being movable vertically along a guide; and
an externally accessible opening button; and pressing the opening button to cause the hinged bottom lid to open so that the coarse dirt separator moves down and slides out from an interior of the dust collection container, wherein the guide includes a plurality of vertically oriented and longitudinally slotted holders, each holder being engaged by a nose included on the coarse dirt separator.

* * * * *